US008757846B2

(12) United States Patent
Otani

(10) Patent No.: US 8,757,846 B2
(45) Date of Patent: Jun. 24, 2014

(54) LAMP UNIT

(75) Inventor: Tomoaki Otani, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 23 days.

(21) Appl. No.: 13/367,391

(22) Filed: Feb. 7, 2012

(65) Prior Publication Data

US 2012/0201033 A1 Aug. 9, 2012

(30) Foreign Application Priority Data

Feb. 8, 2011 (JP) ..... 2011-024991

(51) Int. Cl.
*F21V 7/00* (2006.01)

(52) U.S. Cl.
USPC ..... 362/307; 362/97.1

(58) Field of Classification Search
USPC ..... 362/97.1, 347, 307; 359/732, 839
See application file for complete search history.

(56) References Cited

U.S. PATENT DOCUMENTS

| | | | | |
|---|---|---|---|---|
| 7,070,312 | B2 | 7/2006 | Tatsukawa | |
| 2004/0257826 | A1 | 12/2004 | Tatsukawa | |
| 2009/0273931 | A1* | 11/2009 | Ito et al. | 362/267 |
| 2010/0149787 | A1* | 6/2010 | Zhang et al. | 362/97.1 |

FOREIGN PATENT DOCUMENTS

JP 2005-011704 A 1/2005

OTHER PUBLICATIONS

Office Action issued in counterpart Chinese Patent Application No. 201210027564.5 dated Dec. 26, 2013 (15 pages).

* cited by examiner

*Primary Examiner* — Anne Hines
(74) *Attorney, Agent, or Firm* — Osha Liang LLP

(57) ABSTRACT

A lamp unit for forming a light distribution pattern having a given cutoff line in an upper end portion thereof includes a light source, a transparent member which receives light from the light source from rearward and projects the light distribution pattern forward, and a light shade which is provided between the light source and the transparent member and which shades a part of the light emitted by the light source. The transparent member is configured to reflect, by a front surface of the transparent member, the light that enters the transparent member from rearward thereof, then to reflect again the light to forward thereof by a rear surface of the transparent member, and then to radiate the light from the front surface. The light shade is configured to shade the light going from the light source directly toward the rear surface.

3 Claims, 11 Drawing Sheets

LAMP UNIT

This application claims priority from Japanese Patent Application No. 2011-024991, filed on Feb. 8, 2011, the entire contents of which are hereby incorporated by reference.

FIELD OF THE INVENTION

The present disclosure relates to a lamp unit and, specifically, it relates to a lamp unit for use in a vehicle headlamp.

DESCRIPTION OF RELATED ART

As a related-art lamp unit for use in a vehicle headlamp structured such that it can form a light distribution pattern having a cutoff line in its upper end portion, Japanese Patent Application Publication No. JP-A-2005-11704 discloses a lamp unit which includes a light source constituted of a semiconductor light emitting device and a transparent member for receiving the light from the light source and transmitting the light forwardly of the vehicle head lamp. In the related-art lamp unit, the transparent member is structured such that, after the transparent member reflects the incident light from the light source by its front surface, the transparent member reflects again the light by its rear surface and radiates the light from its front surface. In this case, on the central area of the front surface of the transparent member, there has been executed a mirror surface treatment for internally reflecting the light from the semiconductor light emitting device. Also, on the rear surface of the transparent member, there has been executed a mirror surface treatment for reflecting again the reflected light from the front surface.

However, in the related-art lamp unit, when the light from the light source enters the rear surface of the transparent member directly, other areas than the desired light distribution pattern can be illuminated by the reflected light. In this case, there is a possibility that the light can give the glare to a pedestrian and the occupants of a vehicle existing in such areas.

SUMMARY OF INVENTION

One or more embodiments of the present invention provide a lamp unit which can form a light distribution pattern capable of preventing the occurrence of the glare.

According to one or more embodiments of the invention, a lamp unit for forming a light distribution pattern having a given cutoff line in its upper end portion, includes: a light source; a transparent member configured to receive light from the light source from rearward of the transparent member and to project the light distribution pattern to forward of the transparent member; and a light shade provided between the light source and the transparent member and configured to shade a part of the light emitted from the light source, wherein the transparent member includes a front surface and a rear surface, wherein the transparent member is configured to reflect, by the front surface, the light entered the inside of the transparent member from rearward of the transparent member, then to reflect again the light to forward of the transparent member by the rear surface, and then to radiate the light from the front surface; and wherein the light shade is configured to shade the light going from the light source directly toward the rear surface of the transparent member.

Other aspects and advantages of the invention will be apparent from the following description, the drawings and the claims.

DETAILED DESCRIPTION

Now, description will be given below of embodiments of the invention with reference to the accompanying drawings. The same or equivalent composing elements, members and processings shown in the respective drawings are given the same designations and the duplicate description thereof is omitted properly. Also, the embodiments are merely examples of the present invention and those skilled in the art will appreciate that all characteristics described in the embodiments and the combinations thereof are not always essential. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

The lamp unit according to one or more embodiments of the invention can be used in various vehicle lamps. In the following description, description will be given of a case where the lamp unit according to one or more embodiments of the invention is applied to a vehicle headlamp of the vehicle lamps. Also, lamp units according to the following embodiments of the invention can respectively form a light distribution pattern having a given cutoff line in its upper end portion.

First Embodiment

Figure 1:
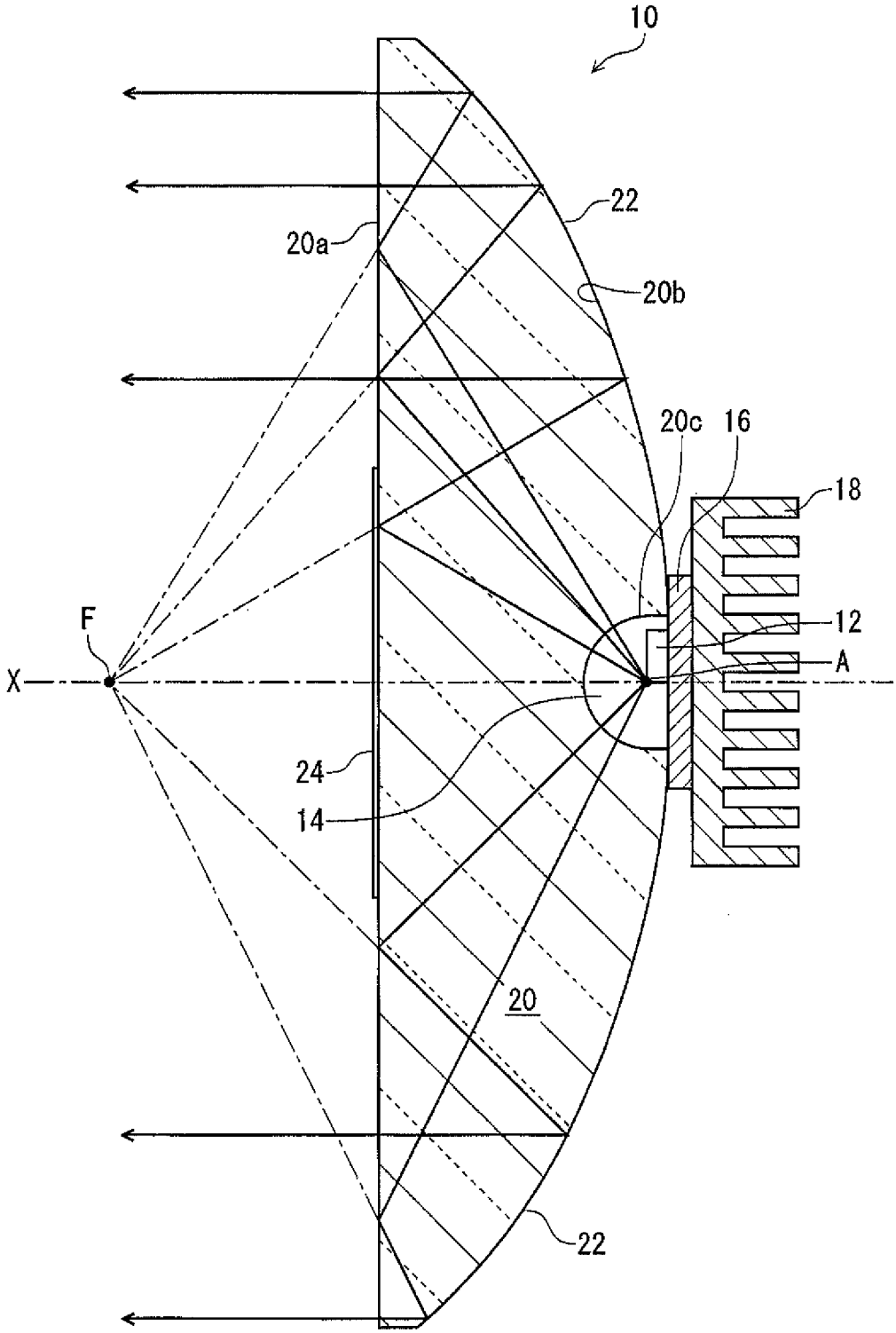
FIG. 1 is a vertical section view of a lamp unit according to a first embodiment of the invention, including the optical axis X of the lamp unit.

Firstly, there is illustrated a schematic structure of a lamp unit 10 according to a first embodiment of the invention. FIG. 1 is a vertical section view of the lamp unit 10 according to the first embodiment, including its optical axis X. The lamp units 10 are respectively disposed in left and right front portions of a vehicle. In the following description, the structure of one of the two lamp units 10 will be described.

The lamp unit 10 includes mainly a light emitting module 16, a radiator fin 18, a transparent member 20, a rear surface reflector 22 and a front surface reflector 24.

The light emitting module 16 uses as its light source a light emitting device 12 such as a rectangular-shaped LED. The light emitting device 12 is disposed on a circuit board and is sealed by semicircular sealing resin. As will be described later, the light emitting device 12 is disposed such that one of the angles of its rectangular shape is situated on an optical axis X. Light emitted from the light emitting device 12 is reflected by the front surface of the transparent member 20, is then reflected further by the rear surface thereof and is radiated from the front surface of the transparent member 20.

The transparent member 20 is a transparent molding of synthetic resin such as acrylic resin, while the transparent member 20 receives the light from the light emitting device 12 from behind and projects a light distribution pattern forwardly thereof. The front surface 20*a* of the transparent member 20 is constituted of a plane intersecting the optical axis X at right angles. The rear surface 20*b* of the transparent member 20 has a focus F situated to have symmetry with a light emission center A constituted of a point of intersection between the light emitting device 12 and optical axis X with respect to the front surface 20*a*, and is formed as a light reflection control surface having as its reference surface a paraboloid of revolution with the optical axis X as its center axis. Therefore, the front surface 20*a* provides a plane situated at equal distances from the light emission center A and focus F.

The front surface 20*a* of the transparent member 20 includes a front surface reflector 24 for internally reflecting the light emitted from the light emitting device 12 onto the rear surface 20*b*. The front surface reflector 24 is a circular area which exists around the optical axis X and on which a mirror treatment has been executed by aluminum evaporation or the like. The outer peripheral edge of the front surface reflector 24 is set at a position where the incident angle of the light from the light emitting device 12 entering the front surface 20*a* of the transparent member 20 is substantially equal to a critical angle of the transparent member 20. Therefore, the light emitted from the light emitting device 12 is internally reflected by the mirror surface treated front surface reflector 24 and is also internally reflected by total reflection on the outer peripheral side of the transparent member 20 not covered with the front surface reflector 24.

That is, the transparent member 20 is structured such that the transparent member 20 reflects rearward the incident light entering the inside thereof from behind by its front surface 20*a*, reflects thereafter the light again forward by its rear surface 20*b*, and then radiates the light from the front surface 20*a*.

The light emitting module 16 is mounted on the rear surface side of the transparent member 20. Also, on the rear surface side of the transparent member 20, there is formed a storage space 14 which surrounds the light emitting device 12. The storage space 14 has a semispherical surface shape with the light emission center A as its center and further the storage space 14 is filled with transparent resin such as epoxy resin. This allows the light emitted from the light emitting device 12 to enter the transparent member 20 without refracting it by the semispherical surface. Here, in the case that a light shade (which will be discussed later) is provided, the storage space 14 may also be formed vacant without using the sealing resin.

The rear surface 20*b* of the transparent member 20 includes thereon a rear surface reflector 22 for reflecting the light reflected by the front surface reflector 24 as the light to be radiated forwardly of the vehicle. On the rear surface reflector 22, over the entire area of the rear surface 20*b* except for a recess portion 20*c*, there has been executed a mirror surface treatment by aluminum evaporation or the like.

Figure 2:
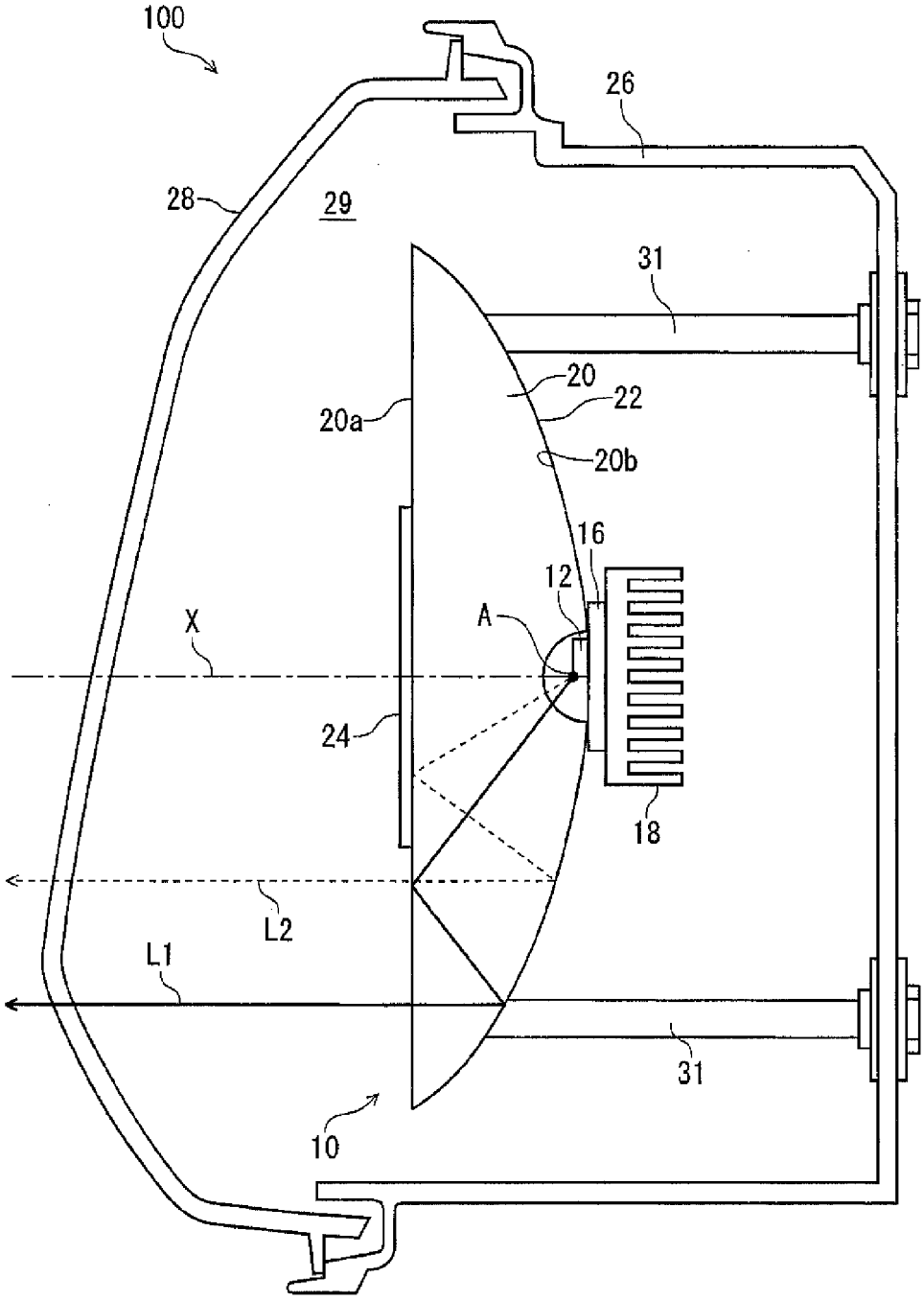
FIG. 2 is a section view of a vehicle headlamp using the lamp unit according to the first embodiment.

FIG. 2 is a section view of a vehicle headlamp 100 using the lamp unit 10 according to the first embodiment. The vehicle headlamp 100, as shown in FIG. 2, includes a lamp body 26 having a recess opened forwardly of the lamp unit 10 and a cover 28 for covering the open surface of the lamp body 26, while the lamp body 26 and cover 28 constitute together an internal space serving as a lamp chamber 29. The lamp unit 10 is disposed within the lamp chamber 29. Here, multiple lamp units may also be disposed within the lamp chamber 29.

As shown in FIG. 2, the lamp unit 10 is mounted on the lamp body 26 through support members 31. The lamp unit 10 is disposed such that its optical axis X extends in the longitudinal direction of the vehicle.

Figure 3:
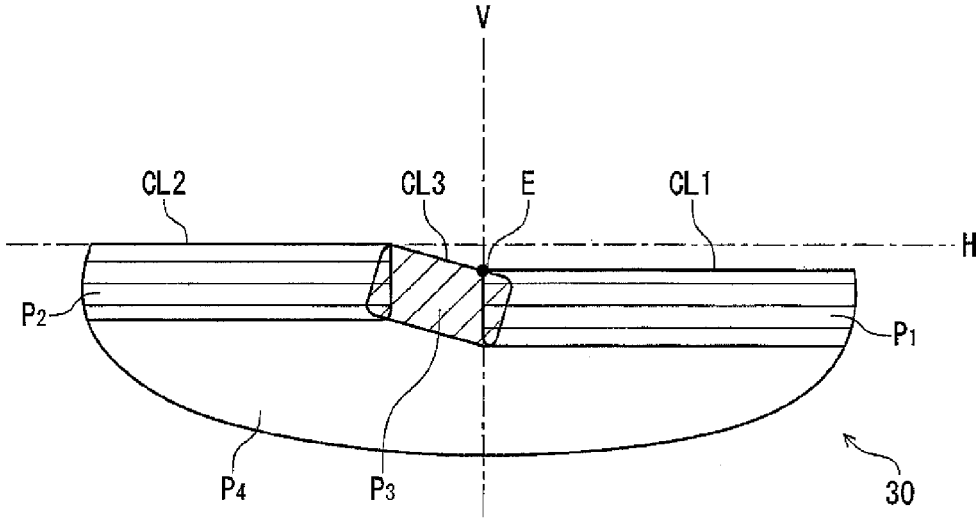
FIG. 3 is a view of a low beam light distribution pattern to be formed on a virtual vertical screen disposed at a given position (for example, 25 m) existing forward from the headlamp by the light radiated forward from the lamp unit according to the first embodiment.

FIG. 3 is a view of a low beam light distribution pattern 30 to be formed on a virtual vertical screen disposed at a given position (for example, 25 m) existing forward from the headlamp by the light radiated forwardly from the lamp unit 10 according to the first embodiment.

The low beam light distribution pattern 30 has cutoff lines CL1 to CL 3 on its upper end edge. The cutoff lines CL1 to CL 3 extend horizontally left and right in different stages with a V-V line as the boundary between them, while the V-V line is a vertical line passing through H-V which is a vanishing point in the front direction of the headlamp. The first horizontal cutoff line CL1 extends horizontally rightward of the V-V line and downward of the H-H line. The inclined cutoff line CL3 extends obliquely at an angle of $\alpha$ (for example, $\alpha \leq 15°$) from the left end portion of the first horizontal cutoff line CL1 toward left upward. The second cutoff line CL2 extends on the H-H line on the left side from a point of intersection between the inclined cutoff line CL3 and H-H line. In the vicinity of an elbow point E which is a point of intersection between the first horizontal cutoff line CL1 and inclined cutoff line CL3, there is formed a hot zone which is a high luminous area.

The low beam light distribution pattern 30 is formed as a composite light distribution pattern of horizontal cutoff line forming patterns P1, P2, an inclined cutoff line forming pattern P3 and a diffused area forming pattern P4. The upper end edge of the horizontal cutoff line forming pattern P1 forms the first horizontal cutoff line CL1, the upper end edge of the horizontal cutoff line forming pattern P2 forms the second horizontal cutoff line CL2, and the upper end edge of the inclined cutoff line forming pattern P3 forms the inclined cutoff line CL3.

Figure 4:
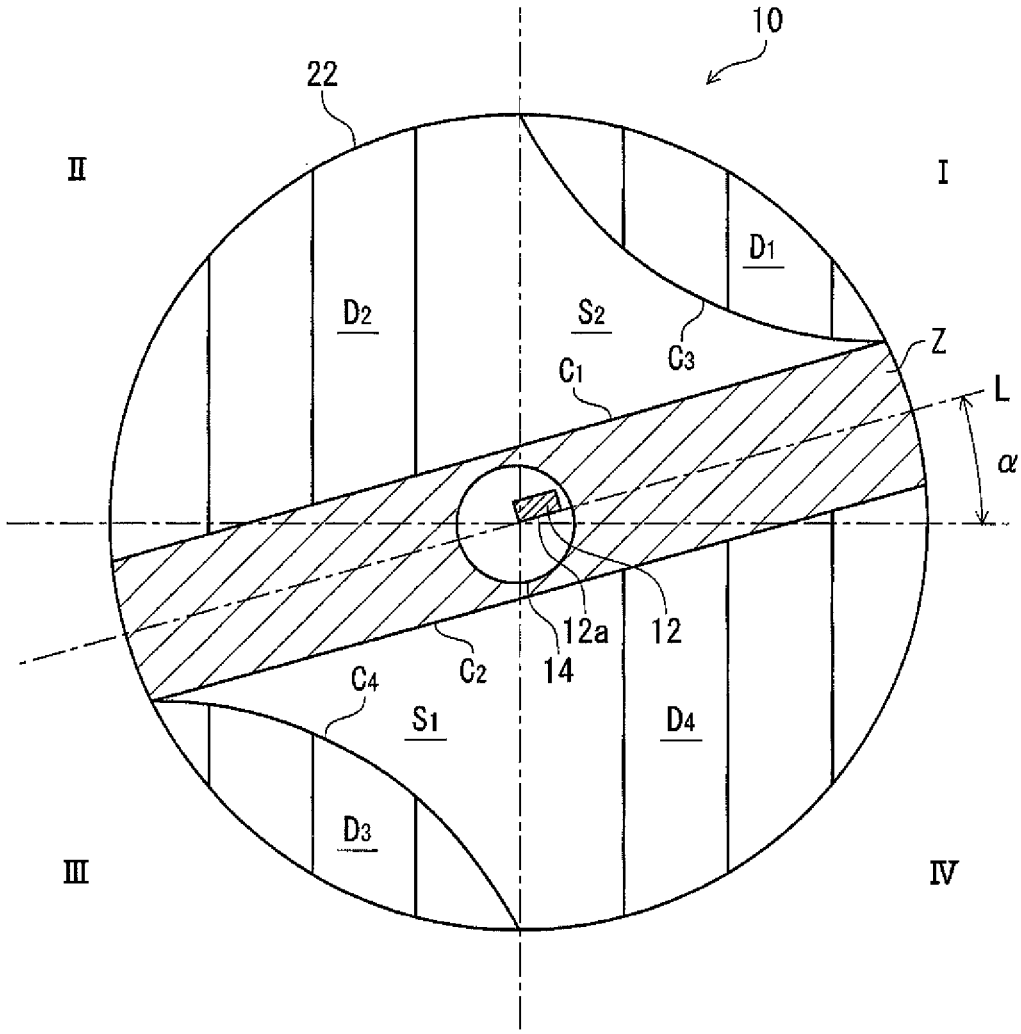
FIG. 4 is a plan view of the lamp unit, when viewed from front of the lamp unit.

FIG. 4 is a plan view of the lamp unit 10, when observed from front. In FIG. 4, in order to explain a light reflection control surface which is the rear surface 20*b* of the transparent member 20, there is omitted the illustration of the front surface reflector 24. In the following description, the light reflection control surface is divided to four sections by a horizontal line and a vertical line respectively passing through the optical axis, which are respectively called areas I to IV counterclockwise from the upper right in FIG. 4.

The light emitting device 12 is disposed such that the lower side 12*a* of its rectangular shape is situated along a line L passing through the optical axis X and extending at an angle equal to the inclination angle $\alpha$ of the inclined cutoff line with respect to the horizontal line. The corner of the lower end of the light emitting device 12 is disposed on the optical axis X.

Figure 5:
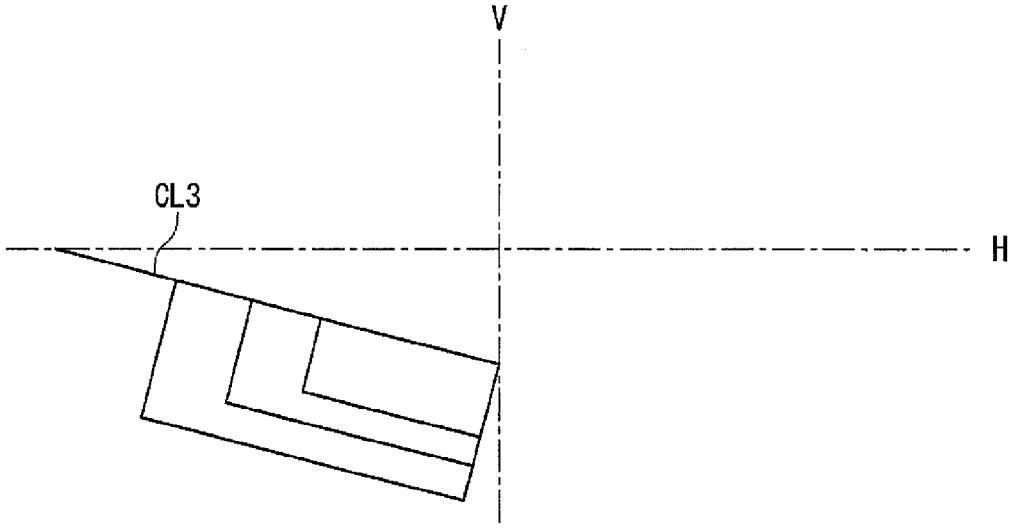
FIG. 5 is a view of a basic light distribution pattern to be formed on a virtual vertical screen by the vehicle headlamp, assuming that the rear surface of the transparent member is a paraboloid of revolution.

FIG. 5 is a view of a basic light distribution pattern to be formed on a virtual vertical screen by the light reflected from an area Z shown in FIG. 4, assuming that the rear surface 20*b* of the transparent member 20 is a paraboloid of revolution. As described above, because the light emitting device 12 is inclined at the inclination angle α with respect to the horizontal line, the basic light distribution pattern is also inclined at the same angle. Also, the contour of the upper end portion of the basic light distribution pattern is formed as the inverted image of the lower side 12*a* of the light emitting device 12 extending in the inclined direction, that is, as the inclined cutoff line CL3. In this embodiment, by adjusting the light reflection control surface of the transparent member 20 based on such basic light distribution pattern, there is formed such a low beam light distribution pattern as shown in FIG. 3.

Returning back again to FIG. 4, in the central portion of the light reflection control surface which is the rear surface 20*b* of the transparent member 20, there is formed a belt-shaped area Z inclined with respect to a horizontal line at an angle equal to the inclination angle α of the inclination cutoff line. This belt-shaped area Z is an area (which is hereinafter referred to as "inclined line forming area") Z for forming the inclined cutoff line CL3. The inclined line forming area Z is set in the vicinity of the light emitting device 12 and a one-dot chained line L which is an extension line of the lower end line of the light emitting device 12. The width of the lower and upper boundary lines C1 and C2 of the inclination line forming area Z is decided according to the size of a hot zone to be formed on the virtual vertical screen. When the width of the boundary lines C1 and C2 is increased, the luminous flux reaching the hot zone increases, whereas, when the width is decreased, the luminous flux of the hot zone decreases.

In the areas I and III of the light reflection control surface, there are formed areas (which are hereinafter referred to as "horizontal line forming areas") S2 and S1 respectively used to form the horizontal cutoff lines.

The horizontal line forming area S1 is a substantially triangular boundary area surrounded by a centrally projecting curved line C4, the boundary line C2 of the inclined line forming portion, and a vertical line. The horizontal line forming area S2 is a substantially triangular boundary area surrounded by a centrally projecting curved line C3, the boundary line C1 of the inclined line forming portion, and a vertical line. The horizontal line forming area S1 forms a horizontal cutoff line forming pattern P1 on a virtual vertical screen, while the horizontal line forming area S2 forms a horizontal cutoff line forming pattern P2.

To set the curved lines C3 and C4, when the rear surface 20*b* of the transparent member 20 is constituted of a paraboloid of revolution, there may be connected together positions where the image of the light emitting device to be formed by the reflection light of the paraboloid of revolution can provide an image having an upper end edge equal to the horizontal cutoff lines CL2, CL1 on the virtual vertical screen. More specifically, the light emitted from the light emitting device 12 and reflected by the front surface 20*a* of the transparent member 20 may be reflected by the rear surface 20*b*; the light may be refracted by the front surface and may be projected on the virtual vertical screen; and, the angle of the end of the projected light may be calculated. And, there may be decided positions on the paraboloid of revolution where the calculated angle is substantially horizontal, and these positions may be connected together, thereby setting the curved lines C3, C4.

Of the light reflection control surface which is the rear surface 20*b* of the transparent member 20, areas D1 to D4 except for the inclined line forming area Z and horizontal line forming areas S1 and S2, are respectively constituted of multiple reflecting elements which are formed as vertical lattices. The reflecting elements respectively diffusion reflect the light emitted from the light emitting device 12 and reflected by the front surface 20*a* of the transparent member 20. The respective reflecting elements are set such that the diffusion angle can be adjusted by changing the curvature of the horizontal direction with respect to the paraboloid of revolution and also a diffusion area forming pattern P4 can be formed on the virtual vertical screen.

As described above, in this embodiment, the light emitting device is disposed inclined, while the light reflection control surface of the transparent member is divided into the inclined line forming area for forming the inclined cutoff line and horizontal line forming area for forming the horizontal cutoff line. This makes it possible for a set of right and left lamp units 10 to form the low beam light distribution pattern.

Figure 6:
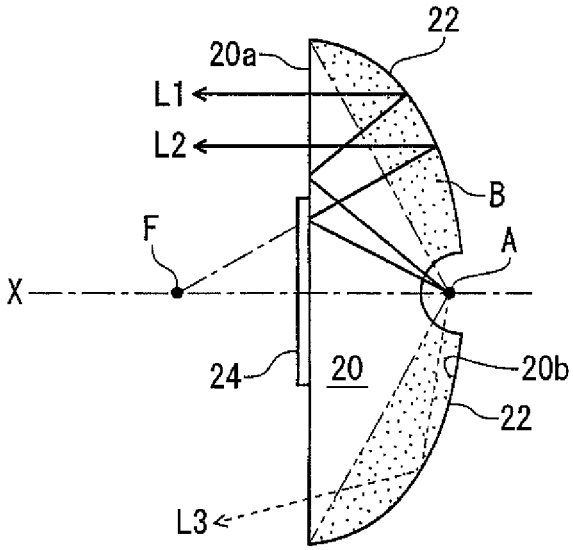
FIG. 6 is a typical view to explain the occurrence of the glare.

Here, the inventors have realized that the above lamp unit 10 can generate the glare. FIG. 6 is a typical view to explain the occurrence of the glare. As shown in FIG. 6, of lights emitted from the light emission center A, lights L1, L2 reflected by the front surface 20*a*, reflected thereafter by the rear surface 20*b* and radiated from the front surface 20*a* of the transparent member 20 form a desired light distribution pattern as the light controlled by the rear surface 20*b* which is the light reflection control surface. However, of lights emitted from the light emission center A, light L3 not reflected by the front surface 20*a* but reflected directly by the rear surface 20*b* is difficult to be controlled by the rear surface 20 serving as the light reflection control surface, thereby raising a possibility that it can provide a factor to give the glare to a vehicle and a pedestrian moving ahead of the vehicle.

Thus, in the first embodiment, a light shade (not shown in FIG. 1) is formed in the storage space 14 of the lamp unit 10 shown in FIG. 1. The light shade is structured such that the light emitted from the light emission center A is prevented from going directly toward a dotted area B shown in FIG. 6.

Figure 7:
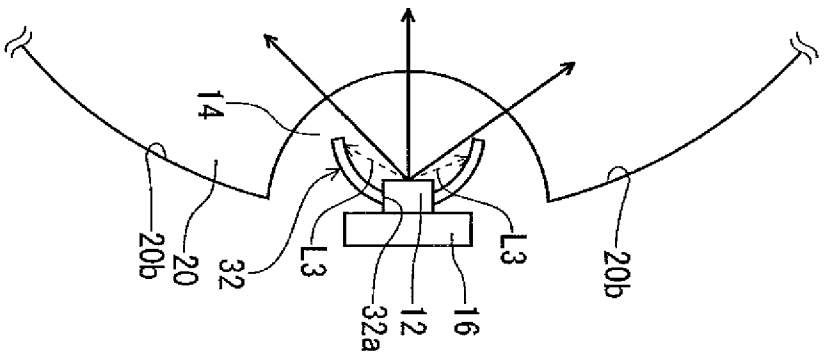
FIG. 7 is an enlarged view of the vicinity of the storage space of the lamp unit according to the first embodiment.

FIG. 7 is an enlarged view of the vicinity of the storage space 14 of the lamp unit 20 according to the first embodiment. Here, illustration of some of the composing parts is omitted properly.

A light shade 32 according to the first embodiment is interposed between the light emitting device 12 and the rear surface 20*b* of the transparent member 20 and is used to shade part of the light emitted from the light emitting device 12. The light shade 32 has a bowl shape and includes in its bottom portion a disposition section 32*a* where the light emitting device 12 can be disposed. The light shade 32 is structured such that it can shade the light L3 going from the light emitting device 12 directly toward the rear surface 20*b* of the transparent member 20, that is, the light going directly toward the dotted area shown in FIG. 6. Thus, because the light going from the light emitting device 12 directly toward the rear surface 20*b* of the transparent member 20 can be shaded, the occurrence of the glare can be controlled.

Second Embodiment

Figure 8:
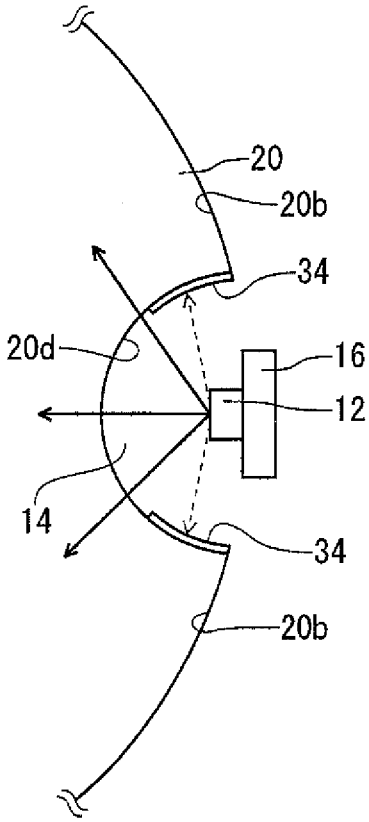
FIG. 8 is an enlarged view of the vicinity of a light shade according to a second embodiment.

FIG. 8 is an enlarged view of the vicinity of a light shade according to a second embodiment. Light shades 34 according to the second embodiment are respectively formed in an incident surface 20*d* from which the light of the light emitting device 12 enters the transparent member 20. The light shades 34 can be realized, for example, by forming a film on the incident surface 20*d* by evaporation or the like, or by bonding a previously produced member on the incident surface 20*d*. Therefore, when compared with a light shade formed in the vicinity of the light emitting device 12 within the storage space 14, the positioning of the light shade can be facilitated.

Third Embodiment

Figure 9:
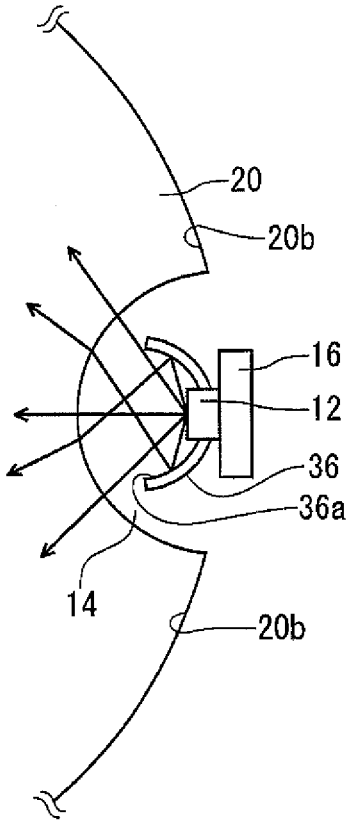
FIG. 9 is an enlarged view of the vicinity of a light shade according to a third embodiment.

FIG. 9 is an enlarged view of the vicinity of a light shade according to a third embodiment. A light shade 36 according to the third embodiment is similar in structure to the light shade 32 according to the first embodiment but is greatly different in that its inner surface 36*a* is reflection treated. That is, the inner surface 36*a* functions as a reflecting surface. Therefore, the light going from the light emitting device 12 directly toward the rear surface 20*b* of the transparent member 20 can also be reflected forwardly of the vehicle. This can also contribute toward formation of a light distribution pattern, thereby being able to enhance the use rate of the luminous flux of the lamp unit.

Fourth Embodiment

Figure 10A:
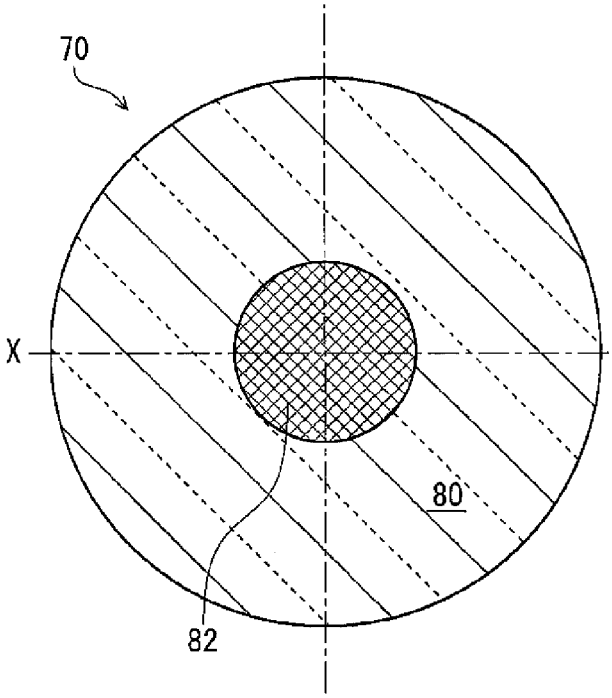
FIG. 10A is a front view of a lamp unit according to a fourth embodiment of the invention.
Figure 10B:
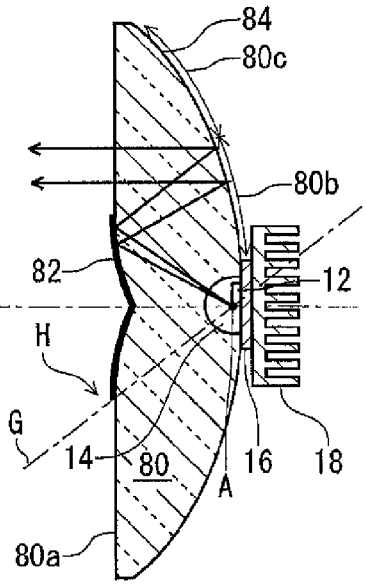
FIG. 10B is a section view of the lamp unit shown in FIG. 10A including its optical axis X.

FIG. 10A is a front view of a lamp unit 70 according to a fourth embodiment, and FIG. 10B is a section view of the lamp unit 70 shown in FIG. 10A including its optical axis X. The fourth embodiment is similar to one or more of the above embodiments in that the light emitting device 12 is disposed inclined, but is different in that its front surface reflector 82 and rear surface reflector 84 have different shapes.

In the case that a position H on the front surface 80*a*, that is, a limit position outside which multiple times of reflection do not occur between the front surface reflector 82 and rear surface reflector 84 is connected to the light emission center A to thereby provide a straight line G, the upper half sections of the front surface 80*a* and front surface reflector 82 are respectively formed to have a paraboloid of revolution formed when a parabola having the straight line G as its axis is revolved around the optical axis X. The lower half sections of the front surface 80*a* and front surface reflector 82 are respectively formed to have symmetry with their respective upper half sections with respect to a horizontal plane including the optical axis X. Further, of the rear surface reflector 84 functioning as the light reflection control surface of the transparent member 80, free-form curved surface area 80*b* which the light reflected by the front surface reflector 82 constituted of a paraboloid of revolution can reach is formed as a free-form curved surface which reflects the light as parallel lights. And, remaining outside paraboloid area 80*c* is formed as a paraboloid similar to one or more of the above-mentioned embodiments. That is, the light reflected by the front surface reflector 82 is reflected by the free-form curved surface area 80*b* of the rear surface reflector 84, while the light reflected by the front surface 80*a* of the transparent member is reflected by the paraboloid area 80*c* of the rear surface reflector 84. Thus, all of the reflected lights from the rear surface reflectors 84 are reflected as parallel lights.

In the case of the structure shown in FIGS. 10A and 10B, when compared with a structure where the front surface of the transparent member is flat, the light emitted from the light emitting device 12 is reflected by the front surface reflector 82 in a direction parting from the optical axis X. This can restrict the re-entry of the light re-reflected by the rear surface reflector 84 into the front surface reflector 82. That is, because multiple times of reflection of the light between the front surface and rear surface is restricted, the luminous flux to be radiated can be increased further. Here, the entire surfaces of the front and rear surface reflectors 82 and 84 may also be formed as free-form curved surfaces.

Although the invention has been described heretofore with reference to the above respective embodiments, the invention is not limited to them but the invention also includes proper combinations of the above embodiments and proper replacements of the composing elements thereof. Also, persons skilled in the art, based on their knowledge, will appreciate appropriate changes to the combinations of the above embodiments and the sequence of the processings to be performed in the respective embodiments, and further may recognize various changes such as various design changes to the above embodiments. The embodiments with such changes added thereto are also intended to fall within the scope of the invention.

In one or more of the above embodiments, because the incident surface 20*d* of the transparent member 20 is formed semispherical, the light from the light emission center transmits as it is without being refracted. This makes it necessary to provide the light shade. On the other hand, in the lamp unit 10 according to one or more of the above embodiments, it is also possible to prevent the light from going from the light emitting device 12 directly toward the rear surface 20*b* of the transparent member 20, without providing such light shade.

Figure 11:
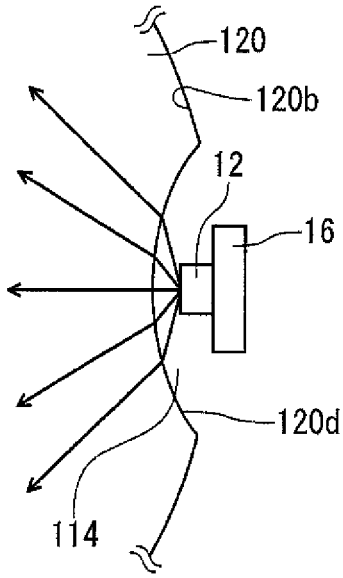
FIG. 11 is an enlarged view of the vicinity of the storage space of a transparent member according to a modification.

FIG. 11 is an enlarged view of the vicinity of a storage space 114 in a transparent member according to a modification example. In a transparent member 120 according the modification example, the shape of its incident surface 120*d* is structured such that the light going from the light emitting device 12 directly toward the rear surface 120*b* of the transparent member 120 is refracted by the incident surface 120*d* toward the front surface of the transparent member 120. Thus, because the light going from the light source directly toward the rear surface of the transparent member is refracted, the occurrence of the glare can be restricted without providing a light shade.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A lamp unit for forming a light distribution pattern having a given cutoff line in an upper end portion thereof, comprising:

a light source; and a transparent member configured to receive light from the light source from rearward of the transparent member and to project the light distribution pattern forward of the transparent member, wherein the transparent member includes a front surface, a rear surface, and a rearward incident surface which faces the light source, wherein the transparent member is configured to reflect, by the front surface, the light that enters the transparent member from rearward of the transparent member, then to reflect again the light forward of the transparent member by the rear surface, and then to radiate the light from the front surface; and wherein the rearward incident surface is configured to refract, toward the front surface, the light going from the light source directly to the rear surface.

2. A lamp unit for forming a light distribution pattern having a given cutoff line in an upper end portion thereof, comprising:

a light source; and a transparent member configured to receive light from the light source from rearward of the transparent member and to project the light distribution pattern forward of the transparent member, wherein the transparent member includes a front surface and a rear surface, wherein the transparent member is configured to reflect, by the front surface, the light that enters the transparent member from the incident surface, then to reflect again the light forward of the transparent member by the rear surface, and then to radiate the light from the front surface; and wherein the front surface of the transparent member includes a front surface reflector formed to have a paraboloid of revolution.

3. The lamp unit according to claim 2, wherein the paraboloid of revolution is formed when a parabola is revolved around an optical axis, wherein the parabola has a straight line as an axis thereof, and wherein the straight line is provided by connecting a light emission center and a position on the front surface which a limit position outside which multiple times of reflection do not occur between the front surface reflector and the rear surface of the transparent member.

* * * * *